US005682591A

United States Patent [19]

Inculet et al.

[11] Patent Number: 5,682,591

[45] Date of Patent: Oct. 28, 1997

[54] POWDER METALLURGY APPARATUS AND PROCESS USING ELECTROSTATIC DIE WALL LUBRICATION

[75] Inventors: Ion I. Inculet; James D. Brown; G. S. Peter Castle, all of London, Canada; Peter Hansen, Fond-du-Lac, Wis.

[73] Assignee: Quebec Metal Powders Limited, Tracy, Canada

[21] Appl. No.: 479,464

[22] Filed: Jun. 7, 1995

Related U.S. Application Data

[63] Continuation-in-part of Ser. No. 294,979, Aug. 24, 1994, abandoned.

[51] Int. Cl.[6] ..... B22F 3/12

[52] U.S. Cl. ..... 419/38; 419/37; 419/54; 425/406

[58] Field of Search ..... 419/37, 38, 54; 72/41, 44; 425/406, 407

[56] References Cited

U.S. PATENT DOCUMENTS

| | | | |
|---|---|---|---|
| 3,556,255 | 1/1971 | Lomax, Jr. | 184/1 |
| 3,581,539 | 6/1971 | Lauener | 72/45 |
| 3,626,043 | 12/1971 | Flipot et al. | 264/37 |
| 3,871,877 | 3/1975 | Stochheim | 75/214 |
| 3,931,020 | 1/1976 | Burgess et al. | 252/30 |
| 3,995,979 | 12/1976 | Fedrigo | 425/78 |
| 4,073,966 | 2/1978 | Scholes et al. | 427/26 |
| 4,110,095 | 8/1978 | Stengle, Jr. | 65/26 |
| 4,221,185 | 9/1980 | Scholes et al. | 118/634 |
| 4,228,670 | 10/1980 | Corti et al. | 72/42 |
| 5,017,122 | 5/1991 | Staniforth | 425/100 |
| 5,085,828 | 2/1992 | Shain et al. | 419/66 |
| 5,093,076 | 3/1992 | Young et al. | 419/12 |
| 5,591,373 | 1/1997 | Ward et al. | 252/62.54 |

FOREIGN PATENT DOCUMENTS

| | | |
|---|---|---|
| 0225803 | 6/1987 | European Pat. Off. . |
| 2253570 | 7/1975 | France . |

*Primary Examiner*—Charles T. Jordan
*Assistant Examiner*—Daniel Jenkins
*Attorney, Agent, or Firm*—Fitzpatrick, Cella, Harper & Scinto

[57] ABSTRACT

A method of making a metal composite part by compacting a metal powder composition in a die whose wall surfaces have been electrostatically coated with a lubricant, thereby eliminating or reducing a lubricant in the metal powder composition, resulting in a metal composite having greater density and strength. The method further includes providing an electrostatic charge to the metal powder composition. A powder metallurgy apparatus is also provided.

13 Claims, 3 Drawing Sheets

POWDER METALLURGY APPARATUS AND PROCESS USING ELECTROSTATIC DIE WALL LUBRICATION

This Application is a continuation-in-part of application No. 08/294,979 filed Aug. 24, 1994, now abandoned.

BACKGROUND OF THE INVENTION

1. Field of the Invention

This invention relates to ferrous powders and, in particular, to the compaction of such materials to form metal composite parts using powder metallurgy.

2. Brief Description of the Background Art

In the compaction of metal powders by powder metallurgy ("P/M") to form a metal composite part, metal powders are pressed in a die cavity to form a green compact which is then heat treated to form a metal composite part. During compaction, a considerable amount of friction is generated between the metal powders and the surfaces defining the die cavity, causing both adhesive wear on the die surfaces and breakage of the green compact when it is released from the die cavity. To decrease these frictional effects and also to reduce the ejection force required to remove the green compact from the die, lubricants have been previously added to the metal powder mixture. These are generally referred to as internal lubricants since they are dispersed throughout the portion of metal powders to be compacted.

Wet lubricants have not been used successfully since they promote clumping of the metal powder, thereby precluding the good flow characteristics normally desired of P/M materials. Dry lubricants have been used successfully since they are non-binding, and do not affect flow characteristics. Dry lubricants typically function by melting due to the pressure and temperature employed during compaction, thereby allowing the melted lubricant to flow. However, one consequence of the inclusion of any internal lubricant in the metal powder formulation is that the attainable final density and the strength of the metal composite part thus produced are less than theoretically possible when no lubricant is added.

Prior attempts to eliminate the inclusion of internal lubricant in the metal powder composition focused on spraying lubricants in liquid form on the die wall. Previously, these lubricants included both liquid lubricants and dry lubricants that were dispersed in solvents. However, drawbacks in the size and shape of the green compact arise due both to poor metering and distribution of liquid applied to the die wall. Moreover, use of dispersed dry lubricants poses numerous health, safety and environmental hazards due to the presence of volatile solvents. While the present inventors believed that it would have been useful to directly apply dry lubricants to the die wall surfaces, no apparatus or method for doing so was previously available.

SUMMARY OF THE INVENTION

It is therefore an object of the present invention to overcome certain drawbacks and disadvantages of the prior art, and to provide an improved method for making a metal composite part by powder metallurgy.

It is an object of the present invention to provide an environmentally safe method for making a metal composite part.

It is another object of the present invention to provide a method for making a metal composite part which eliminates the need to include an internal lubricant in the metal powder composition.

It is a further object of the present invention to provide a method for making a metal composite part having a final density of greater than 7.30 g/cm$^3$.

Another object of the present invention is to provide an apparatus capable of uniformly spraying a dry or wet lubricating material onto a die surface.

These objects and others are provided by a novel method of making a metal composite part by powder metallurgy wherein the metal powder composition is pressed in a die cavity whose wall surfaces have been lubricated by electrostatically spraying lubricants in either dry or liquid form. This method eliminates the need to include an internal lubricant in the powder metallurgy composition resulting in a metal composite part having greater density and strength. In addition, since dry lubricants may be employed without being dispersed in volatile solvents, the present invention is environmentally safe.

These objects are further accomplished by the present invention which provides an apparatus for spraying a wet or dry lubricating material, comprising: spraying means for spraying the lubricating material; charging means for applying an electrical charge to the lubricating material; and means for imparting a reversing potential to an electrode disposed on a powder metallurgy die. The potential causes an electrical attraction to take place between the charged lubricating material and the powder metallurgy die.

More specifically, the present invention provides a method for making a green compact comprising:

providing a die having a cavity defined by wall surfaces;

selecting a metal powder composition suitable for powder metallurgy;

electrostatically spraying a lubricant on the wall surfaces of said die;

filling the die cavity with the metal powder composition; and compacting said metal powder composition in said die to form a green compact.

In another embodiment, the present invention relates to a process for making a metal composite part comprising:

providing a die having a cavity defined by wall surfaces;

selecting a metal powder composition suitable for powder metallurgy;

electrostatically spraying a lubricant on the wall surfaces of said die;

filling the die cavity with the metal powder composition;

compacting said metal powder composition in said die to form green compact;

removing said green compact from the die; and sintering said green compact to form said metal composite part.

In both embodiments above, the die cavity and the metal powder composition may be preheated to a high temperature of up to 700° F. prior to the compacting step. In addition, in both embodiments above, the metal powder composition may be electrostatically charged, such as with triboelectric charging.

In a further embodiment, the present invention relates to a powder metallurgy apparatus comprising:

means for receiving a die having a die cavity;

spraying means for spraying lubricating material into said die cavity;

charging means for applying an electrical charge to the lubricating material; and means for imparting a potential to an electrode disposed adjacent to said die cavity.

DETAILED DESCRIPTION OF THE INVENTION

Figure 1:
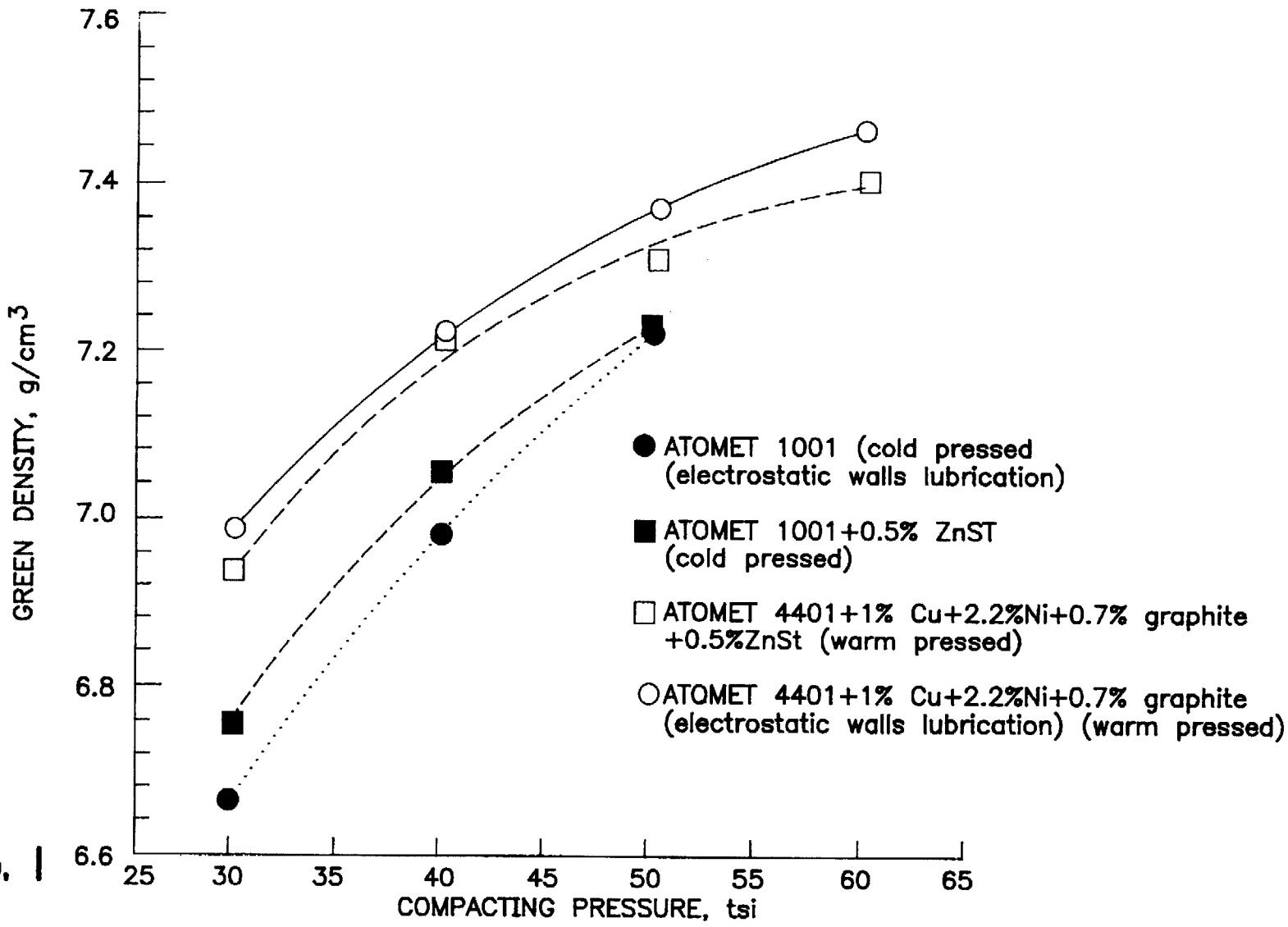
FIG. 1 illustrates the predicted compressibility curves of metal powder compositions without lubricant compacted in a die which is electrostatically sprayed with a lubricant according to the present invention using both cold and warm pressing and the compressibility curves of comparative metal powder compositions conventionally blended with a solid internal lubricant and compacted in an unlubricated die using both cold and warm pressing.

In the present invention, the lubricant is electrostatically applied to the wall surfaces of the die in either liquid or solid form. More specifically, the lubricant is electrostatically applied in the form of an aerosol of fine liquid droplets or solid particles. Preferably, the liquid droplets or solid particles have a size of 100 microns or less, more preferably 50 microns or less and most preferably 15 microns or less.

By electrostatically charging the liquid droplets or solid particles, a thin lubricating coating can be applied quickly and uniformly on die wall surfaces which are at least partially conducting. The electrostatically sprayed droplets or particles are drawn to and held on the wall surfaces by image forces which are induced by the approaching charged particle. The same forces, combined with the space charge of the cloud of droplets or particles, allow the droplets or particles to wrap around corners so as to cover all parts of the wall surfaces. The coating is uniform because the charge retained on previously deposited particles tends to deflect incoming particles or droplets to uncovered sites.

Suitable apparatus for electrostatically applying lubricating materials in conformity with the present invention include, for example the following components: a nozzle for spraying a solid or liquid lubricant; a substrate which constitutes a P/M die disposed beneath the nozzle and a polarity reversing DC high-tension power source.

In the above-described arrangement, lubricant is sprayed from the nozzle and is provided with a triboelectric charge. At this time, since the die is connected to ground, electrical attraction acts between the lubricating material and the die, and the lubricant reaches the P/M die to be deposited thereon. A reversible DC voltage of from 100 V–50 kV is applied to an electrode which is electrically isolated from the die to enhance the attraction of the unipolarly charged lubricant to the die.

The lubricants that can be electrostatically sprayed in accordance with the present invention ideally have a low electrical conductivity and sufficient resistivity so that the charges are retained in the deposited droplets or particles for a sufficient period of time to ensure adherence to the die wall surfaces.

As described above, the lubricants can be in either dry or liquid forms. Suitable dry lubricants include metal stearates, such as zinc stearate, lithium stearate, and calcium stearate, ethylene bistearamide, polyolefin-based fatty acids, polyethylene-based fatty acids, soaps, molybdenum disulfide, graphite, manganese sulfide, calcium oxide, boron nitride, polytetrafluoroethylene and natural and synthetic waxes. Particularly preferred is ethylene bistearamide, such as that sold commercially by Lonza Corp. under the tradename Acrawax®.

Suitable liquid lubricants include liquid-dispersed solid lubricants discussed above; oil-based lubricants such as petroleum oils, silicone oils, and hydrocarbon oils; solvent-based lubricants such as polyglycols and polyphenyl ethers; and water-based lubricants such as soaps and aqueous wax emulsions.

All solid and liquid lubricants may be used as single component lubricants, or may be used in admixtures of two or more lubricants. Additionally, solid and wet lubricants of various types may be used in any combination as may be desired.

In the process of electrostatically spraying the lubricant on the wall surfaces of a die, lubricant in solid particle or liquid droplet form is ejected from nozzle which is preferably provided by a Tribogun®. The solid lubricant particles may be sprayed dry or, if desired, dispersed in any suitable solvent or solvent system.

The solid lubricant particles or liquid lubricant droplets may be ejected in air, or in another dispersant such as isopropyl alcohol, n-hexane, butane, Freon® fluorinated hydrocarbon (trademark of E. I. Du Pont de Nemours & Co.) and the like. If a dispersant other than air is used as a medium for dispersing solid lubricant particles or liquid lubricant droplets, the dispersant is allowed to subsequently evaporate. Preferably, the lubricant particles or droplets are electrostatically sprayed to a thickness such that the ejection pressure required to eject the green compact is minimized. Of course, the thickness can be varied to achieve desirable ejection forces to the extent that it does not affect P/M properties.

The type of metal powder composition used in the present invention may be any conventional metal powder composition, including but not limited to iron, steel, or steel alloyed powders. Typical iron powders are the Atomet® iron powders manufactured by Quebec Metal Powders Limited (QMP) of Tracy, Quebec, Canada, the assignee of the present invention. Typical steel or steel alloyed powders include Atomet® 1001, 1001 HP, 4201, 4401, and 4601 manufactured by QMP. The metal powder generally has a maximum particle size of less than about 300 microns, preferably less than about 212 microns. The metal powder may also be bound with a suitable binder such as those disclosed in U.S. Pat. Nos. 3,846,126; 3,988,524; 4,062,678; 4,834,800; and 5,069,714, the disclosures of which are hereby incorporated by reference. Those skilled in the art readily will be able to identify alternative or equivalent metal powders.

Preferably, the lubricant should be electrostatically charged, such as by triboelectric charging. The lubricant may be so charged by passing the composition on a puff of air through a coiled Teflon tube. The charge-to-mass ratio of the triboelectrically charged lubricant should be above 0.2 μC/g, generally above 0.6 μC/g, with a charge-to-mass ratio of greater than about 1.2 μC/g being preferred. Of course, the polarity of the charge-to-mass ratio may vary depending upon the materials selected. The total charge of the charged lubricant may be measured with an electrometer. (The charge-to-mass ratio may be measured by collecting the charged lubricant in a double Faraday pail. The mass of the composition charged is readily determined by carefully removing all powder collected in the Faraday pail and weighing on a standard balance with a sensitivity of 1 mg.)

The metal powder composition is compacted in a die 4 of any desired shape. In a further embodiment of the present invention, the die may be adapted to include warm pressing and any configuration to achieve near net shape compaction and to facilitate ejection from the ie cavity.

Compaction can be conducted with any process, including warm pressing and cold pressing. Generally speaking, warm pressing is conducted at a pressure of about 30 to 60 tsi (tons per square inch) and at a temperature of about 50° to 300° C. and cold pressing is conducted at a pressure of about 15 to 60 tsi and at a temperature of about 15° to 50° C.

After the green compact is ejected from the die cavity, it is sintered to form the metal composite part. Any conventional sintering process can be employed to form the metal composite part according to the present invention. Preferably, sintering is conducted at a temperature of 1,000° to 1,300° C. and for a period of 10 to 60 minutes. Since the green compact may preferably omit all internal lubricant, the sintering may include induction heating. In this event, presintering may be omitted.

Of course, this invention is also suitable for use in any P/M process, for example, including the organic binding processes such as those disclosed in U.S. Pat. No. 5,069,714, the double-press double-sinter processes such as those disclosed in commonly assigned co-pending U.S. patent application Ser. No. 08/067,282, filed May 26, 1993, and the processes for manufacturing a soft composite iron material such as those disclosed in commonly assigned co-pending U.S. patent application Ser. No. 08/060,965 filed May 14, 1993. The metal composite part made according to the present invention is capable of achieving, if desired, a final density of greater than 7.30 g/cm$^3$ and/or a sintered strength of greater than 2,000 Mpa. Particularly high green densities may be achieved in accordance with the present invention when the pressed compositions contain from small amounts of internal lubricant, on the order of 0.1–0.4 wt. %, preferably 0.2–0.3 wt. % (in contrast to the 0.75 wt. % commonly used conventionally, in the absence of die wall lubrication).

The method of the present invention now will be illustrated with the following examples.

EXAMPLE 1

A rectangular (TRS) die having wall surfaces will be electrostatically sprayed with a solid Acrawax® lubricant by blowing Acrawax® particles by means of compressed air into a tribogun. The charged particles will then be sprayed onto the die wall surfaces. The die will then be heated to a temperature of 80° C. and a metal powder composition of Atomet® 4401+1.0% Cu+2.2% Ni+0.7% C will be injected. The metal powder composition will then be compacted in the die at pressures of 30, 40, 50, and 60 tsi while the die temperature is maintained at 250° C. The predicted compressibility curve is illustrated in FIG. 1. Additional green compacts will be made by compacting the metal powder composition only at 50 tsi. The green compacts thus produced will then be ejected from the die and sintered at a temperature of 1120° C. for 25 minutes. The predicted green and sintered properties of the compacts are shown in Table 1.

COMPARATIVE EXAMPLE 1

The process as described in Example 1 was conducted except that 0.5% zinc stearate solid lubricant was blended in the metal powder composition and the die was not electrostatically sprayed with any lubricant. The compressibility curve is illustrated in FIG. 1 and the green and sintered properties of the compacts at 50 tsi are shown in Table 1.

TABLE 1

| | DIE WALL ELECTROSTATICALLY SPRAYED | BLENDED WITH 0.5% ZnSt |
|---|---|---|
| COMPACTING PRESSURE, tsi | 50 | 50 |
| GREEN STRENGTH, psi | 7900 | 4400 |
| FINAL DENSITY, g/cm$^3$ | 7.32 | 7.30 |
| HARDNESS, HRC | 31 | 34 |
| DIMENSIONAL CHANGE, % to green size | +0.15 | −0.02 |
| SINTERED STRENGTH, Mpa | 2,250 | 1,810 |

Referring to Table 1, both the green strength of the green compact and the sintered strength of the metal composite part formed by compacting the metal powder composition in the die electrostatically sprayed with graphite will be substantially higher than those formed by compacting the metal composition blended with 0.5% zinc stearate in the die not electrostatically sprayed with any lubricant. In addition, the final density will be higher for the metal composite part formed by compacting in the die electrostatically sprayed with graphite.

EXAMPLE 2

A rectangular die having wall surfaces will be electrostatically sprayed with Acrawax lubricant by blowing Acrawax particles by means of compressed air into a tribogun in which the graphite particles are charged by direct current. The charged particles will then be sprayed onto the die wall surfaces and a metal powder composition of Atomet® 1001 will be injected into the lubricated die. The metal powder composition will then be cold pressed in the die at pressures of 30 tsi, 40 tsi, and 50 tsi. The predicted compressibility curve is illustrated in FIG. 1.

COMPARATIVE EXAMPLE 2

The process as described in Example 2 was conducted except that 0.4% zinc stearate solid lubricant was added to the metal powder composition and the die was not electrostatically sprayed with any lubricant. The resultant compressibility curve is illustrated in FIG. 1.

Referring to FIG. 1, green compacts formed by warm pressing metal powder compositions in a die electrostatically sprayed with a Acrawax lubricant will have a green density ranging from about 7.0 to about 7.5 g/cm$^3$, which is higher than the green density range of about 6.9 to 7.4 g/cm$^3$ achieved by green compact formed by warm pressing the metal powder compositions blended with 0.5% zinc stearate in a die that was not electrostatically sprayed with any lubricant.

Still referring to FIG. 1, green compacts formed by cold pressing metal powder compositions in a die electrostatically sprayed with Acrawax lubricant will have a lower green density at 30 and 40 tsi than green compacts formed from cold pressing metal powder compositions blended with 0.4% zinc stearate in a die that was not electrostatically sprayed with any lubricant. However, at 50 tsi the green density of both will be substantially the same.

EXAMPLE 3

Metal powder compositions of Atomet® 1001 will be separately blended with 0.0, 0.2, and 0.4% Acrawax® C ethylene bistearamide wax, and will be cold pressed at various pressures in a die whose wall surfaces will have been previously electrostatically sprayed with zinc stearate. The predicted compressibility and green strength curves are shown in FIG. 2 and FIG. 3, respectively.

Figure 2:
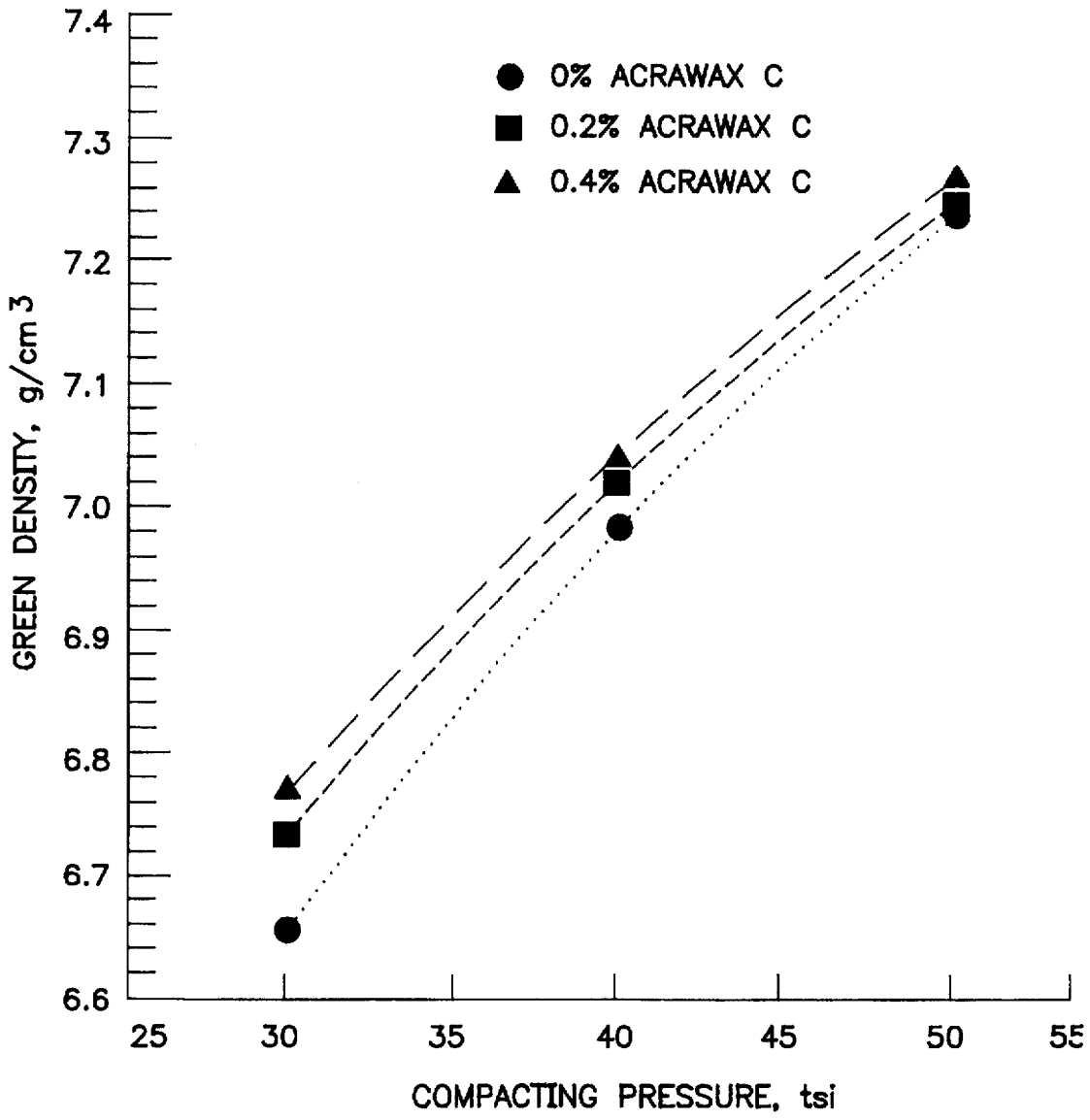
FIG. 2 illustrates the predicted compressibility curves of compacting metal powder compositions blended with varying amounts of internal lubricant in a die electrostatically sprayed with a lubricant.
Figure 3:
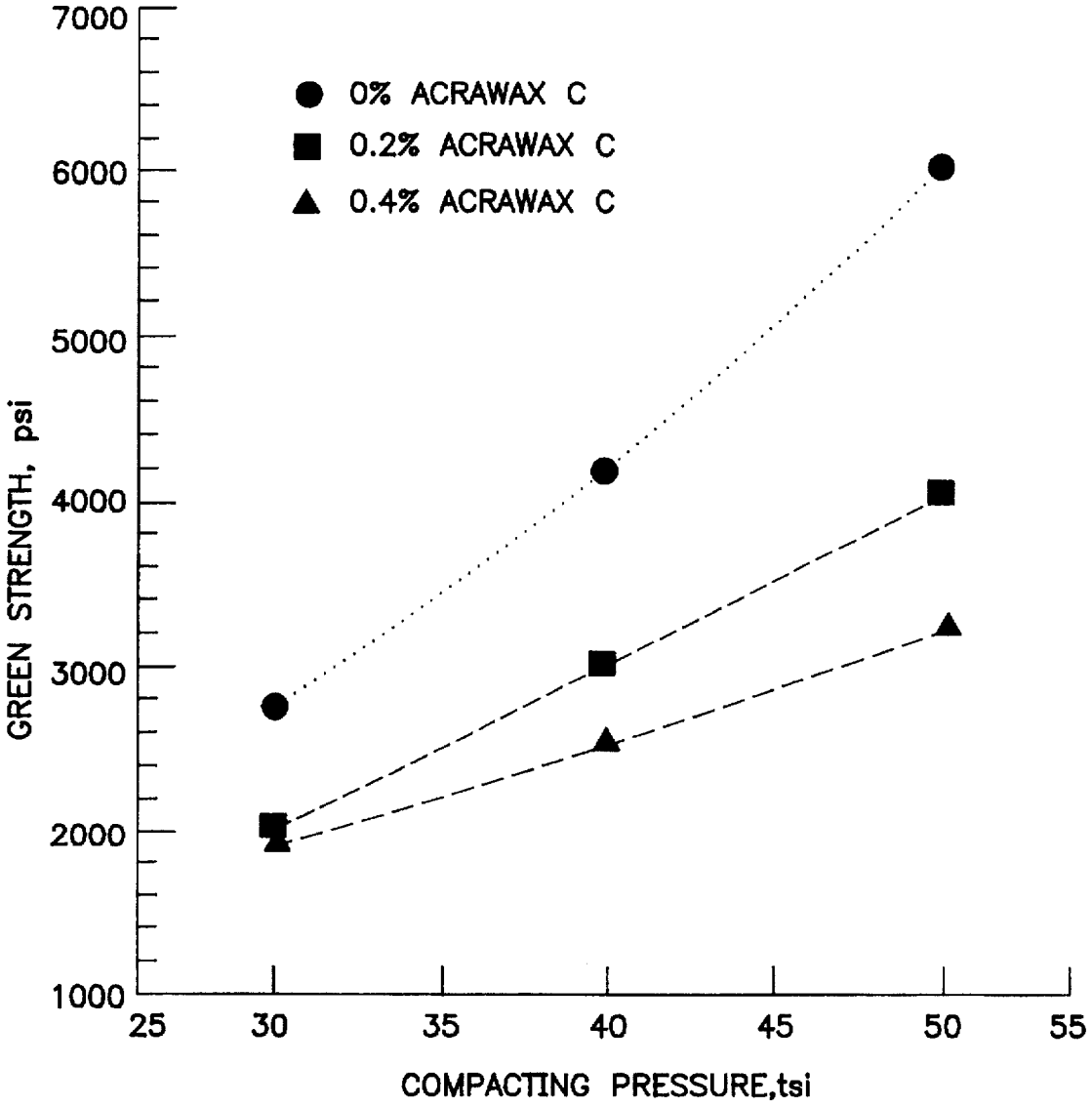
FIG. 3 illustrates the predicted green strength curves of compacting metal powder compositions blended with varying amount of internal lubricant in a die electrostatically sprayed with a lubricant.

FIGS. 2 and 3 demonstrate the predicted effects of including a solid lubricant in the metal powder composition prior to compaction. FIG. 2 shows that including a solid lubricant in the metal powder composition will have minimal effect on the green density of the green compact at tsi greater than 40. The predicted advantage of excluding the lubricant from the metal powder composition is clearly demonstrated by FIG. 3, which shows that the green strength of the green compact that will be formed by compacting the metal powder composition with no Acrawax® C will be substantially higher than the green strength of the metal powder compositions blended with 0.2 and 0.4% Actawax C.

COMPARATIVE EXAMPLE 3

Various powdered lubricants (specifically, graphite, boron nitride, Acrawax° C and lithium stearate) were triboelectrically charged by being manually fed into a coiled 80 cm Teflon® tube and passed through the tube on a puff of air at a pressure of about 75 kP.

The lubricants were applied to a test die constructed of two aluminum cylinders and an acrylic base such that the base held the two cylinders in place with a constant distance of 1.3 cm between them. The cylinders projected 3.5 cm above the acrylic base, leaving an annular cavity 1.3 cm and 3.5 cm in cross-section. The outside diameter of the cavity was 12 cm. The charged lubricants emerged from the Teflon® tube approximately 10 cm above the test die but were not deposited uniformly or with adequate quantity on the walls of the die cavity.

The charge-to-mass ratio for each lubricant was calculated by dividing the total charge by the mass of powder collected in the Faraday pail. In the case of the graphite and boron nitride powders the results were erratic with some changes in polarity. Both the Acrawax® and lithium stearate powders charged positively.

Table 2 shows the measured charge-to-mass ratio for five samples of each of Acrawax® or lithium stearate, and the average charge-to-mass ratio of the respective five samples.

TABLE 2

| Sample | Acrawax ®, μC/g | lithium stearate, μC/g |
|---|---|---|
| 1 | (+)2.32 | (+)1.50 |
| 2 | (+)1.89 | (+)0.69 |
| 3 | (+)2.52 | (+)1.05 |
| 4 | (+)2.25 | (+)2.40 |
| 5 | (+)2.42 | (+)1.40 |
| Average | (+)2.28 | (+)1.41 |

EXAMPLE 4

To further aid deposition of the blended compositions of Comparative Example 3, a ring electrode was placed around the outside of the die. A potential was applied to the electrode and a puff of triboelectrically charged lubricant was deposited in the die as described above.

Deposition in the die of the charged lubricant occurred very quickly and provided a thick, uniform layer of charged lubricant on one surface of the die. With a positive polarity on the electrode, charged lubricant was deposited only on the outside surface of the inside ring of the die; with a reversal in polarity, charged lubricant was deposited only on the inside surface of the outside ring of the die.

Although the present invention has been illustrated with reference to certain preferred embodiments, it will be appreciated that the present invention is not limited to the specifics set forth therein. Those skilled in the art readily will appreciate numerous variations and modifications within the spirit and scope of the present invention, and all such variations and modifications are intended to be covered by the present invention, which is defined by the following claims.

What is claimed is:

1. A method for making a green compact comprising:
   - providing a die having a cavity defined by wall surfaces;
   - selecting a metal powder composition suitable for powder metallurgy;
   - selecting a die wall lubricant suitable for powder metallurgy;
   - triboelectrically charging the lubricant with a charge-to-mass ratio of above 0.2 μ/g;
   - electrostatically attracting said charged lubricant on a wall surface of said die;
   - reversibly charging the polarity of the die;
   - filling the die cavity with the metal powder composition; and
   - compacting said metal powder composition in said die to form a green compact.

2. The method according to claim 1, wherein the lubricant is electrostatically sprayed in dry form.

3. The method according to claim 2, wherein the lubricant is electrostatically sprayed as solid particles.

4. The method according to claims 1 or 3, wherein said compacting occurs at a temperature of about 50° to 300° C.

5. The method according to claim 4, wherein the lubricant is selected from metal stearates, ethylene bistearamide, polyolefin-based fatty acids, polyethylene-based fatty acids, soaps, molybdenum disulfide, graphite, manganese sulfide, calcium oxide, boron nitride, polytetrafluoroethylene, or natural or synthetic waxes.

6. The method according to claim 1, wherein the lubricant is selected from liquid-dispersed solid lubricants, oil-based lubricants, solvent-based lubricants, and water-based lubricants.

7. The method according to claim 4, wherein the metal powder composition is selected from iron, steel, or steel alloyed powders.

8. The method according to claim 7, wherein the metal powder composition is not blended with any lubricant.

9. The method according to any of claims 1–3, further comprising:
   - removing said green compact from the die; and
   - sintering said green compact to form said metal composite part.

10. The method according to claim 9, wherein the metal composite part has a density of greater than 7.30 g/cm$^3$.

11. The method according to claim 9, wherein the metal composite part has a sintered strength of greater than 2,000 MPa.

12. A powder metallurgy apparatus comprising:
   - means for receiving a die having a die cavity;
   - triboelectrically charging means for charging die wall lubricating material;
   - spraying means for spraying triboelectrically charged lubricating material into said die cavity;
   - means for generating a reversing electric field in said die cavity; and means for heating said die cavity.

13. A powder metallurgy apparatus comprising:

means for receiving a die having a die cavity;

triboelectric charging means for charging die wall lubricating material;

spraying means for spraying triboelectrically charged lubricating material into said die cavity;

means for generating a reversing electric field in said die cavity; and means for heating a powder blend and introducing heated powder blend into said die cavity.

* * * * *

UNITED STATES PATENT AND TRADEMARK OFFICE

CERTIFICATE OF CORRECTION

PATENT NO. : 5,682,591

DATED : October 28, 1997

INVENTOR(S) : Ion I. Inculet, et. al.

It is certified that error appears in the above-indentified patent and that said Letters Patent is hereby corrected as shown below:

COLUMN 2

Line 50, "green" should read --a green--.

Line 57, "metal powder composition" should read --lubricant--.

COLUMN 4

Line 23, "nozzle" should read --a nozzle--.

COLUMN 5

Line 9, "ie" should read --die--.

COLUMN 6

Line 33, "graphite" should read --lubricant--.

Line 49, "with a" should read --with--.

COLUMN 7

Line 17, "Actawax" should read --Acrawax--;

Line 21, "Acrawaxo" should read --Acrawax--.

Line 57, "blended compositions" should read --lubricant--.

UNITED STATES PATENT AND TRADEMARK OFFICE

CERTIFICATE OF CORRECTION

PATENT NO. : 5,682,591
DATED : October 28, 1997
INVENTOR(S) : Ion I. Inculet, et. al.

It is certified that error appears in the above-identified patent and that said Letters Patent is hereby corrected as shown below:

COLUMN 8
Line 19, "μ/g" should read --μC/g--;
Line 66, "and means" should read --and
¶ means--.

Signed and Sealed this

Thirtieth Day of June, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,682,591

DATED : October 28, 1997

INVENTOR(S): ION I. INCULET ET AL.

It is certified that error appears in the above-identified patent and that said Letters Patent is hereby corrected as shown below:

ON TITLE PAGE AT [57] ABSTRACT

Line 7, "metal powder composition" should read --lubricant--.

Signed and Sealed this

First Day of December, 1998

*Attest:*

*Attesting Officer*

Bruce Lehman

BRUCE LEHMAN

*Commissioner of Patents and Trademarks*